US006024158A

United States Patent [19]

Gabathuler et al.

[11] Patent Number: 6,024,158

[45] Date of Patent: Feb. 15, 2000

[54] PROCESS FOR MANUFACTURING DIECAST PARTS

[75] Inventors: Jean-Pierre Gabathuler, Schleitheim, Switzerland; Ivan Gyöngyös, Singen, Germany; Hans-Günther Thurner, Baldham, Germany; Jürgen Wüst, Erding, Germany

[73] Assignee: Bayrisches Druckguss-Werk Thurner GmbH & Co. KG, Markt Schwaben, Germany

[21] Appl. No.: 08/737,764

[22] PCT Filed: Mar. 19, 1996

[86] PCT No.: PCT/EP96/01182

§ 371 Date: Nov. 18, 1996

§ 102(e) Date: Nov. 18, 1996

[87] PCT Pub. No.: WO96/29165

PCT Pub. Date: Sep. 26, 1996

[30] Foreign Application Priority Data

Mar. 20, 1995 [EP] European Pat. Off. ..... 95104092

[51] Int. Cl.[7] ..... B22C 3/00; B22D 17/14; B22D 17/20

[52] U.S. Cl. ..... 164/61; 106/38.22; 106/38.27; 164/65; 164/72; 164/113; 164/138

[58] Field of Search ..... 164/72, 138, 113, 164/61, 63, 65; 106/38.22, 38.27; 427/135, 133

[56] References Cited

U.S. PATENT DOCUMENTS

| | | | |
|---|---|---|---|
| 2,045,913 | 6/1936 | Hoy et al. | 164/72 X |
| 3,008,202 | 11/1961 | Bauer . | |
| 4,463,793 | 8/1984 | Thurner | 164/155.5 |
| 5,076,339 | 12/1991 | Smith | 164/72 |
| 5,076,344 | 12/1991 | Fields et al. | 164/457 |

FOREIGN PATENT DOCUMENTS

| | | | |
|---|---|---|---|
| 0124680 | 11/1984 | European Pat. Off. . | |
| 0241426 | 10/1987 | European Pat. Off. . | |
| 0255475 | 2/1988 | European Pat. Off. . | |
| 2323426 | 11/1974 | Germany . | |
| 3002886 | 7/1981 | Germany . | |
| 49-27429 | 3/1974 | Japan | 164/138 |
| 60-137541 | 7/1985 | Japan | 164/72 |
| 60-203335 | 10/1985 | Japan | 164/72 |
| 772678 | 10/1980 | U.S.S.R. | 164/138 |
| 1235609 | 6/1986 | U.S.S.R. | 164/72 |

OTHER PUBLICATIONS

Patent Abstracts of Japan, vol. 8, No. 249 (M–338) [1686], Nov. 15, 1994, & JP,A,59–125255, Fusou Keigoukin, Jul. 19, 1984.

Database WPI, Derwent Publications Ltd., London, G.B. AN 94–061685 XP002004092 & JP,A,06–015 406, Hitachi Funmatsu, Jan. 25, 1994.

*Primary Examiner*—J. Reed Batten, Jr.

*Attorney, Agent, or Firm*—Weingarten, Schurgin, Gagnebin & Hayes LLP

[57] ABSTRACT

Parts are diecast from a light metal alloy which in the molten state is fed under gravity into a casting chamber of a diecasting machine and whence forced by a plunger into a mould chamber which undergoes controlled evacuation in accordance with the position of a plunger. A parting compound is applied to at least one mold half and the application of a lubricant to the plunger. The light metal alloy consists of a primary alloy of invariable composition, with a limit placed on the proportions of Cu, Fe and Zn; the alloy undergoes smelting treatment, de-gassing and/or filtration before being introduced. The vacuum in the mould chamber is below 50 mbar when the molten alloy is introduced and the parting compound contains alkali halides and anti-corrosion additives.

25 Claims, No Drawings

PROCESS FOR MANUFACTURING DIECAST PARTS

TECHNICAL FIELD

The present invention relates to a method for the production of diecastings from a light metal alloy. Diecasting methods for the production of light metal parts for all kinds of further use in industry, e.g. in the automotive industry or in the production of appliances, have been further developed in recent years, particularly with a view to producing large numbers of items at an economic price. One of such methods is referred to as squeezecasting which involves a subsequent compression in the actual mould, or the socalled MFT process developed by the applicant of the present invention and disclosed in DE-OS 23 23 426 and DE-PS 30 02 886, which has considerably contributed to accelerating the evacuation of the mould chamber. As a result, injection operations (commonly referred to as shots) can be performed faster, thus increasing the output figures.

Moreover, the production method has been improved with regard to parting compounds and lubricants for the mould interiors and also for the plunger, thus likewise increasing productivity.

BACKGROUND OF THE INVENTION

U.S. Pat. No. 5,076,344 for example discloses a process in which a molten standard aluminum alloy is fed to a casting or fill chamber through a suction tube. From there, the molten aluminum alloy is then charged into the casting chamber and into the evacuated chamber of a mould, by means of a piston. Inside said mould chamber, the concentration of the parting compound, an alkali halide, is 0.5 to 3% by weight, whereas in the casting chamber the concentration of this parting compound which simultaneously acts as a lubricant here, is between 2 to 7% by weight. The parting compound preferred in this process is an aqueous solution of potassium iodide. The parting compound which is applied to the mould and the plunger prevents the aluminum alloy from sticking to the walls of the mould chamber or the plunger piston, resp. and the casting chamber. The parting compound thus contributes to a continuous and smooth flow of the process.

The disadvantage involved in the use of alkali halides, particularly potassium iodide, is that this salt will corrode the steel-containing parts of the apparatus performing said process. Moreover, the feed process, which is effected via a suction tube, is awkward. Another problem associated with this prior art process is that the quality of the diecastings is impaired by gas inclusions as well as other impurities. The corrosion of the steel can lead to impurities in the metal alloy since corroded bits and particles may come off the steel surface.

Furthermore, the known processes are often complex, thus requiring a machine of likewise complex construction which in turn results in high maintenance costs—all of which makes these processes uneconomic.

Meanwhile, the industries further processing such light metal parts have come to expect additionally improved material properties such as higher strength, lower weights, thin walls, complex geometries, capability of being further processed such as weldability, heat treatability or the possibility of using modern connection technologies when assembling or installing and disassembling or removing such parts.

DISCLOSURE OF THE INVENTION

It is therefore the object of the present invention to provide a process which fulfills the abovementioned requirements. This object is accomplished according to the invention by a combination of the following features:

Primary alloys are used. These are of an invariable composition, with a limit placed on the proportions of copper, iron and zinc. Starting materials for such primary alloys are e.g. AlSi7Mg0.3 having a eutecticum content of approx. 35% and exhibiting high ductility and high fatigue strength, as well as eutectic or almost eutectic Al—Si alloys, various Al—Mg alloys and high-purity Mg alloys.

Before these alloys are introduced, they are subjected to a smelting treatment such as de-gassing and/or filtration.

The vacuum produced in the mould chamber is below 50 mbar when the molten alloy is introduced.

The parting compound applied to the mould surfaces before the melt is introduced comprises alkali halides and anti-corrosion additives.

This combination fulfills the requirements, with almost all conventional pressure diecasting machines being adaptable to the new process and its sequence. Preferably, machines are used whose casting chamber is filled under gravity.

According to the invention it was found that the detrimental effect of the alkali halides on the steel-containing parts of the apparatus for the process can be reduced or avoided altogether if the pH value of the parting compounds is adjusted to at least 8 by adding anti-corrosion additives. This will allow the process to be carried out continuously and more effectively over a long period of time. The additives added are e.g. hexamethylenetetramine, dicyclohexylamine nitrite or potassium hydroxide. Hexamethylenetetramine and dicyclohexylamine nitrite are added to the parting compounds as set out above at a concentration of approx. 0.02 to 0.5% by vol., preferably at a concentration of 0.05 to 0.25% by vol.

In order to avoid any precipitation or flocculation of the parting compound, particularly when potassium iodide is used, in a further preferred embodiment of the invention additives are added to the parting compound for stabilization purposes. The preferred stabilizing agent is sodium thiosulfate at a concentration of 0.01 to 0.5% by volume. This prevents a pronounced reduction of the quality of the parting compound, thus in turn influencing the quality of the diecastings.

In a further preferred embodiment of the invention, preservation additives are added to the parting compound. As a preferred additive, sodium thiosulfate is added to the parting compound which will counteract the decomposition of the parting compound under UV light, and/or other organic addition agents or admixtures such as fungicides or bactericides preventing the formation of fungi or the like. This ensure a long term durability of the parting compound according to the invention.

As an alternative, parting compounds can be used which contain graphite dust instead of alkali halides. Graphite based parting compounds were already used as long as 20–30 years ago. However, their use was gradually reduced more and more with a view to increased productivity, due to the considerable soiling of the casting apparatus and the resulting time-intensive cleaning and maintenance work. However, as already mentioned, the object of the present process according to the invention is not increased productivity but improved quality of the diecasting. In this respect, graphite additives which have been improved compared to the past are now used. The improvement results in a smaller particle size of between 1–1.5 $\mu$m, as well as the use of graphite additives in higher dilutions.

With a view to improved quality, as a further alternative, an agent protected by the trademark AQUADAG and sold by the U.S. company Acheson may be used in an aqueous dilution of 1:70 to 1:200.

A further advantage of the process according to the invention is that the quality of the diecasting is improved since inclusions resulting, for example, from separate products of parting compounds and lubricants, are avoided or reduced. This also considerably improves the ductility of the product. This considerable improvement of the diecasting quality is due to the fact that the vacuum used in the process according to the invention is much higher than the vacuum used in the prior art processes. The vacuum according to the invention is in a range of below 50 mbar. This improved vacuum of the process according to the invention is obtained by the plunger having an extension in the direction of the piston movement axis. This extension will cause sealing of the casting chamber when the piston exits on the side of the mould chamber. This prevents the parting compound, air and other gaseous separate products from entering the casting chamber via the inlet opening. A further improvement of the vacuum is obtained in that the casting chamber opening has a closing means disposed radially movably with respect to the movement of the piston. The effect of the closing means is that it also prevents any air from being sucked in, at the same time extending the time available for the evacuation of the mould chamber.

A further problem sufficiently known from the prior art is that the molten metal alloy encounters a cooler environment when filled into the casting chamber, which causes part of the molten metal alloy in the apparatus to solidify. Such premature solidification may not only have a detrimental effect on the continuous sequence of the process but may also result in a poorer quality of the diecast material.

In order to avoid any such premature solidification, one further aspect of the inventive process provides for the casting chamber to be heated before the molten metal alloy is filled in so that premature solidification cannot occur in the first place. A further alternative is to manufacture the casting chamber from a material having a low coefficient of thermal conduction. The use of ceramic materials is particularly advantageous for this purpose.

In order to further reduce the number of air inclusions in the molten metal alloy, the cross-section of the casting chamber is "banana"-shaped. This embodiment has the effect that the molten alloy flow which moves through the casting chamber in a wave-like manner does not flow back into the casting chamber at the end and thus cannot cause further air and gas inclusions which may be produced by the turbulences and intermixtures involved.

Moreover, the technique of supplying metal (to the apparatus) according to the inventive process is advantageous compared to the supply techniques known from the prior art. Whilst the prior art frequently uses the vacural suction technique, i.e. the feeding of metal via a suction tube, the process according to the invention provides for the feeding of metal into the casting chamber via a common ladle or a metering oven. From a technical point of view, the use of a ladle or a metering oven is easier to handle than the use of a suction tube.

The parts produced according to the present invention not only exhibit improved strength, better anti-corrosive properties, but they can also be further processed more easily, as is shown in the following table.

| | Standard diecasting | MFT (German patent 3002886) | present invention |
|---|---|---|---|
| Weldable | no | only using an electron beam | yes |
| Heat treatment | max 400° C. | 480–500° C. | 530° C. |
| Breaking elongation (at Rp 0.2 = 140 MPa) | ≧3% | ≧6% | ≧15% |
| Yield point | ≧160 MPa (at A5 = 1%) | ≧160 MPa (at A5 = 3%) | ≧200 MPa (at A5 = 6%) |
| Fatigue strength under reversed bending stresses ($10^7$ cycles) | 80–100 MPa | >100 MPa | >120 MPa |
| corrosion resistance against salt water | conditional | conditional | good |

The parts produced according to the new process may be designed to have very thin walls and a large area. Their favourable shaping properties will allow the designer to choose from a large number of possible designs. By appropriately shaping reinforcement elements for example, one may produce junction elements or suspension parts for a car body for the automotive industry. In this respect, the advantages of the lightweight material due to its reduced weight are put to beneficial use. Nevertheless, the remaining requirements such as constant quality of a series production, high ductility, weldability and thus also the ability to be repaired are at the same time fulfilled. Also, crash safety requirements are fulfilled. Various kinds of connection techniques make it possible to combine this material with sheet metals or extrusion moulded profiles.

The lubricants used in the process according to the invention are those known from the prior art. However, lubricants preferred for use in the present invention are hexamethylenetetramine and dicyclohexylamine nitrite each at a concentration of 0.02 to 0.5% by volume.

We claim:

1. A process for the production of die castings from a light metal alloy having a limited iron content, which in the molten state is fed under gravity into a casting chamber in a die casting machine, and whence forced by a plunger into a mould chamber which undergoes controlled evacuation in accordance with the position of said plunger, comprising the steps of:

applying a parting compound selected from the group consisting of an alkali halide to which anti-corrosion additives are added up to a pH value of at least 8, or graphite powder of a particle size of between 1 and 1.5 $\mu$m to at least one mould half, applying a lubricant to the plunger wherein the light metal alloy consists of a primary alloy of invariable composition, with a limit placed on the proportions of Cu, Fe and Zn; which alloy undergoes de-gassing and/or filtration before being introduced, the vacuum in the mould chamber is below 50 mbar when the molten alloy is introduced.

2. The process of claim 1 wherein the casting chamber is heated or made from material having a low coefficient of thermal conduction.

3. The process of claim 1 wherein the plunger has an extension in the direction of the axis of movement of the piston, which extension causes sealing of the filling chamber upon exit of the piston on the side of the mould chamber and prevents air form being drawn in via the inlet opening of the casting chamber.

4. The process of claim 1 wherein the casting chamber opening has a movable closing means which is disposed radially to the movement of the piston.

5. The process of claim 1 wherein the cross-section of the casting chamber is banana-shaped.

6. The process of claim 1 wherein the parting compound contains potassium iodide (0.5–5%).

7. The process of claim 1 wherein the parting compound contains the additive hexamethylenetetramine at a concentration of between approximately 0.02 and 0.5% by volume.

8. The process of claim 1 wherein the parting compound contains the additive dicyclohexylamine nitrite at a concentration of between approximately 0.02 and 0.5% by volume.

9. The process of claim 1 wherein the parting compound contains the additive potassium hydroxide.

10. The process of claim 1 wherein additives are added to the parting compound for stabilizing purposes.

11. The process of claim 10 wherein the additive used for stabilizing the parting compound is sodium thiosulfate.

12. The process of claim 11 wherein the sodium thiosulfate is added at a concentration of between 0.01 and 0.5% by volume.

13. The process of claim 1 wherein additives are added to the parting compound for preservation purposes.

14. The process of claim 13 wherein the additive added to the parting compound for preservation purposes is sodium thiosulfate.

15. The process of claim 13 wherein the additive added to the parting compound for preservation purposes is an organic aggregate.

16. The process of claim 15 wherein fungicides and/or bactericides are added as additives.

17. The process of claim 1 wherein the lubricant contains hexmethlyenetetramine at a concentration of 0.02 to 0.5% by volume.

18. The process of claim 1 wherein the lubricant contains dicyclohexylamine nitrite at a concentration of 0.02 to 0.5% by volume.

19. A parting compound for use in a die casting process according to claim 1, containing alkali halides in an aqueous solution, wherein the parting compound contains anti-corrosion additives and has a pH value of at least 8.

20. The parting compound of claim 19 wherein the alkali halides include potassium iodide (0.5–5%).

21. The parting compound of claim 19 wherein the parting compound has a pH value of between pH 8 and pH 9.

22. The parting compound of claim 19 wherein the additives comprise hexmethylenetetramine or dicyclohexylamine nitrite at a concentration of between 0.02 to 0.5% by volume.

23. The parting compound of claim 19 wherein the additive is potassium hydroxide.

24. The parting compound of claim 22 wherein the additive for stabilizing the parting compound is sodium thiosulfate.

25. The parting compound of claim 24 wherein the parting compound contains sodium thiosulfate at a concentration of between 0.01 to 0.5% by volume.

* * * * *

UNITED STATES PATENT AND TRADEMARK OFFICE

CERTIFICATE OF CORRECTION

PATENT NO. : 6,024,158
DATED : February 15, 2000
INVENTOR(S) : Jean-Pierre Gabathuler et al.

It is certified that error appears in the above-identified patent and that said Letters Patent is hereby corrected as shown below:

Title page,
Item [73], Assignee, "Bayrisches Druckguss-Werk Thurner GmbH & Co. KG." should read -- Alusuisse Bayrisches Druckguss-Werk GmbH & Co. KG --

Signed and Sealed this

Third Day of December, 2002

JAMES E. ROGAN
*Director of the United States Patent and Trademark Office*